US008523610B2

(12) United States Patent
Kuster

(10) Patent No.: US 8,523,610 B2
(45) Date of Patent: Sep. 3, 2013

(54) CONNECTOR FOR MULTIPLE INTERFACE CONNECTION STANDARDS

(76) Inventor: Martin Kuster, Walchwil (CH)

( * ) Notice: Subject to any disclaimer, the term of this patent is extended or adjusted under 35 U.S.C. 154(b) by 33 days.

(21) Appl. No.: 13/362,343

(22) Filed: Jan. 31, 2012

(65) Prior Publication Data

US 2012/0196483 A1 Aug. 2, 2012

Related U.S. Application Data

(60) Provisional application No. 61/438,140, filed on Jan. 31, 2011.

(51) Int. Cl.
*H01R 13/648* (2006.01)

(52) U.S. Cl.
USPC ..... 439/607.01

(58) Field of Classification Search
USPC ..... 439/607.01, 607.09, 607.11, 607.32, 439/660
See application file for complete search history.

(56) References Cited

U.S. PATENT DOCUMENTS 7,270,570 B1 * 9/2007 Hamner et al. ..... 439/607.04
7,771,215 B1 8/2010 Ni et al.
7,921,233 B2 4/2011 Chung
7,938,659 B1 * 5/2011 Zhu et al. ..... 439/218
8,079,879 B2 * 12/2011 Chiang ..... 439/660
8,133,079 B2 * 3/2012 He ..... 439/660
8,152,568 B2 * 4/2012 Wu ..... 439/660
8,215,996 B2 * 7/2012 Su et al. ..... 439/660
2010/0020515 A1 1/2010 Rubino et al.
2010/0082893 A1 4/2010 Ma et al.
2010/0202106 A1 8/2010 Kuster

* cited by examiner

*Primary Examiner* — Tulsidas C Patel
*Assistant Examiner* — Phuongchi T Nguyen
(74) *Attorney, Agent, or Firm* — Kilpatrick Townsend & Stockton LLP

(57) ABSTRACT

Described are connectors having a substrate, a first interface connection terminal set electrically coupled to the substrate, a second interface connection terminal set electrically coupled to the substrate, a third interface connection terminal set electrically coupled to the substrate, a housing coupled to the substrate and surrounding at least a portion of the first interface connection terminal set, the second interface connection terminal set, and the third interface connection terminal set, and a shell coupled to the housing and the substrate, wherein the first interface connection terminal set and the second interface connection terminal set are configured to support at least two interface connection standards with interfaces that are mechanically different.

11 Claims, 11 Drawing Sheets

CONNECTOR FOR MULTIPLE INTERFACE CONNECTION STANDARDS

CROSS REFERENCE TO RELATED APPLICATION

This application is related to and claims priority benefits from U.S. Provisional Application Ser. No. 61/438,140, filed on Jan. 31, 2011, entitled UNIVERSAL USB 1, 2, 3, ESATA I, II, III CONNECTOR. The '140 application is hereby incorporated herein in its entirety by this reference.

FIELD OF THE INVENTION

The invention relates to mobile storage devices and the like.

BACKGROUND

Universal Serial Bus ("USB") and External Serial Advanced Technology Attachment ("eSATA") are two types of commonly used standards for connectors. Each of these standards have undergone rapid development since their inception.

The USB standard that governs the design of the USB connections has undergone several revisions since its earliest release in 1994. The first widely adopted version, USB 1.1, specified data rates of 1.5 Mbit/s ("Low-Bandwidth") and 12 Mbit/s ("Full-Bandwidth"). USB 1.1 was replaced by USB 2.0 in 2000. USB 2.0 provided a higher maximum data transfer rate of 480 Mbit/s ("Hi-Speed"). In this version, the USB 2.0 cable has four wires: two wires for power (+5 volts and ground) and a twisted pair of wires for carrying data. In the USB 2.0 design, as well as USB 1.1, data is transmitted in one direction at a time (downstream or upstream).

In 2008, a new USB 3.0 standard was announced. USB 3.0 includes a new "SuperSpeed" bus, which provides a fourth data transfer rate of 5.0 Gbit/s. In order to achieve this increased throughput, the USB 3.0 cable has a total of eight wires: two wires for power (+5 volts and ground), the twisted pair for carrying non-SuperSpeed data (allows backward compatibility with earlier versions of USB devices), and two differential pairs for carrying SuperSpeed data. Full-duplex signaling occurs over the two differential pairs. To date, adoption of the USB 3.0 standard has been slow due to the need to re-design motherboard hardware that supports the USB 3.0 standard, and the need to revise operating systems to support the USB 3.0 standard.

Traditionally, SATA is an internal computer bus interface for connecting host bus adapters to mass storage devices. First generation SATA interfaces ("SATA I") specified data transfer rates 1.5 Gbit/s. Second generation SATA interfaces ("SATA II") specified data rates of 3.0 Gbit/s. All SATA data cables meeting the SATA spec are rated for 3.0 Gbit/s. In 2009, the third generation SATA interface ("SATA III") was released, specifying a peak throughput of 6 Gbit/s. The SATA III standard is backwards compatible with SATA II. eSATA was standardized in 2004 and provides a variant of the SATA protocols for external connectively. In each version of eSATA ("eSATA I", "eSATA II", and "eSATA III"), the hardwire includes two differential pairs of wires, plus an additional three ground wires. Because eSATA uses the same ATA protocol as a computer's internal hard drive, a bridge chip is not needed to translate from the computer's internal ATA protocol to another protocol, such as USB. However, while most computers use SATA standards internally, many computers do not include external SATA connectors, opting instead to include external USB connectors.

Because eSATA connectors are not yet widely available, it is desirable to provide eSATA connectors that include full backward and forward compatibility between the SATA I, II, and III standards, in combination with USB connectors that include full backward and forward compatibility between the USB 2.0 and 3.0 standards.

SUMMARY

Embodiments of the invention may comprise a connector having a substrate, a first interface connection terminal set electrically coupled to the substrate, a second interface connection terminal set electrically coupled to the substrate, a third interface connection terminal set electrically coupled to the substrate, a housing coupled to the substrate and surrounding at least a portion of the first interface connection terminal set, the second interface connection terminal set, and the third interface connection terminal set, and a shell coupled to the housing and the substrate, wherein the first interface connection terminal set and the second interface connection terminal set are configured to support at least two interface connection standards with interfaces that are mechanically different. In certain embodiments, the shell is metal.

In some embodiments, the first interface connection terminal set comprises a plurality of conductive pads. The second interface connection terminal set may comprise a plurality of springs. In certain embodiments, the substrate comprises a plurality of apertures, wherein each of the plurality of springs of the second interface connection terminal set are partially enclosed within each of the plurality of apertures. The third interface connection terminal set may comprise a plurality of springs. In some embodiments, the housing comprises a plurality of channels, wherein each of the plurality of springs of the third interface connection terminal set are partially enclosed within each of the plurality of channels.

In some embodiments, a recess is positioned between a lower surface of the housing and a component surface of the substrate. At least one controller may also be electrically coupled to the substrate. The controller may be at least partially surrounded by the housing and/or may be positioned within a recess, which is positioned between a lower surface of the housing and a component surface of the substrate.

DETAILED DESCRIPTION

Figure 1:
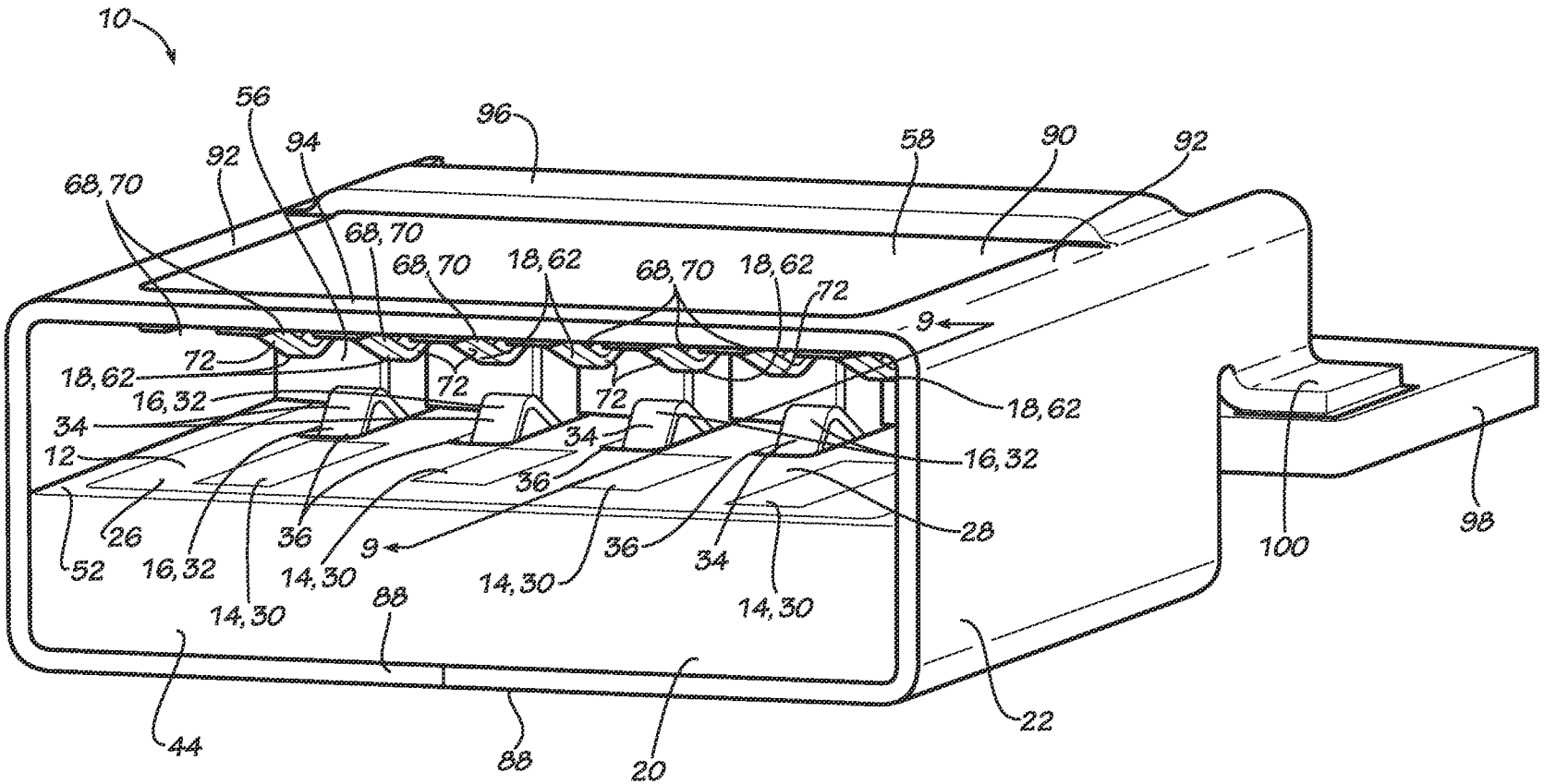
FIG. 1 is a front perspective view of a connector according to certain embodiments of the present invention.

The described embodiments of the invention provide connectors for use with multiple interface connection standards. While the designs may be discussed for use with eSATA and USB standards, they are by no means so limited. Rather, embodiments of these designs may be used for other devices that couple to any type of serial bus connection, parallel bus connection, or otherwise as desired.

FIGS. 1-12 illustrate embodiments of a connector 10 with multiple interface connection standards. In the embodiments shown in FIGS. 1-12, the connector 10 comprises a substrate 12, a first interface connection terminal set 14, a second interface connection terminal set 16, a third interface connection terminal set 18, a housing 20, and a shell 22.

As best shown in FIGS. 1-5 and 8-12, the substrate 12 may be a printed circuit board ("PCB"), which is used to mechanically support and electrically connect the first interface connection terminal set 14, the second interface connection terminal set 16, and the third interface connection terminal set 18 to other components that may be mounted to the substrate 12. In some embodiments, the substrate 12 may include a component surface 24 and a connection surface 26. Items such as an oscillator, an LED status light, discrete components, or other suitable devices, may be mounted and electrically coupled to the component surface 24 and/or the connection surface 26.

In some embodiments, as illustrated in FIGS. 1 and 3-5, the first interface connection terminal set 14 may be positioned proximate an end 28 of the substrate 12 and configured to be inserted within corresponding connector using the first interface connection standard. In some embodiments, such as the embodiments illustrated in FIGS. 1 and 3-5, the first interface connection terminal set 14 may comprise a plurality of conductive pads 30. In these embodiments, the conductive pads 30 may be mounted to or embedded within the connection surface 26 of the substrate 12 and electrically coupled to the substrate 12. In certain embodiments, such as where the first interface connection standard is a USB 2.0 standard or any other standard that is forward or backwards compatible with the USB 2.0 standard, the conductive pads 30 may be configured to electrically couple to the power and ground wires and the twisted pair of wires (for Hi-Speed and lower data transfer) of the corresponding USB 2.0 connector when the connector 10 is inserted within the corresponding USB 2.0 connector. In the embodiments shown in FIGS. 1 and 3-5, the first interface connection terminal set 14 may comprise four conductive pads 30. However, one of ordinary skill in the relevant art will understand that any suitable number and configuration of conductive pads 30 may be used in conjunction with the first interface connection standard or other suitable standards.

In some embodiments, as illustrated in FIGS. 1, 3-5, and 9-10, the second interface connection terminal set 16 may be positioned proximate the end 28 of the substrate 12, as well as behind and/or proximate the first interface connection terminal set 14, and configured to be inserted within a corresponding connector using the second interface connection standard. In some embodiments, such as the embodiment illustrated in FIGS. 1, 3-5, and 9-10, the second interface connection terminal set 16 may comprise a plurality of contact springs 32. Each spring 32 may be formed of a resilient material that, when bent or compressed, exerts a force to return to its original shape. One of ordinary skill in the relevant art will understand that the springs 32 may be made of any suitable material and have any suitable design that allows the second interface connection terminal set 16 to electrically couple to the corresponding connector when the connector 10 is inserted within the corresponding connector. In certain embodiments, such as where the second interface connection standard is a USB 3.0 standard or any other standard that is forward or backwards compatible with the USB 3.0 standard, the springs 32, in combination with the conductive pads 30, may be configured to electrically couple to the power and ground wires, the twisted pair of wires (for Hi-Speed and lower data transfer), and the two differential pairs of wires (for SuperSpeed data transfer) of the corresponding USB 3.0 connector when the connector 10 is inserted within the corresponding USB 3.0 connector. In the embodiments shown in FIGS. 3 and 5-6, the second interface connection terminal set 16 may comprise five springs 32. However, one of ordinary skill in the relevant art will understand that any suitable number and configuration of springs 32 may be used in conjunction with the second interface connection standard or other suitable standards.

Each spring 32 may also include a coupling projection 34, as best illustrated in FIGS. 1, 4-5, and 9-10. In some embodiments, the coupling projection 34 may be integrally formed with the spring 32. In other embodiments, the coupling projection 34 may be soldered or otherwise electrically coupled to the spring 32 in a suitable manner that allows the coupling projection 34 to be electrically coupled to the substrate 12. The coupling projection 34 may have any suitable shape that provides sufficient contact with the corresponding connector when the connector 10 is inserted within the corresponding connector. Examples of suitable shapes include but are not limited to a triangular, L-shape, U-shape, T-shape, solid projection having a circular or rectilinear cross-sectional shape, or other suitable shapes.

The substrate 12 may include a plurality of apertures 36 in the connection surface 26 adjacent the plurality of springs 32. The plurality of apertures 36 may be shaped so that the coupling projection 34 of each spring 32 extends through the aperture 36 and is positioned above the connection surface 26, while the remainder of the spring 32 body is positioned within the substrate 12, when each spring 32 is in an uncompressed position.

Each spring 32 may include an extension 38 that mounts to and electrically couples the spring 32 to the substrate 12 via a coupling point 40 located on the connection surface 26. The substrate 12 may include a separate coupling point 40 for each spring 32. In some embodiments, as shown in FIGS. 3, 5-6, and 9-10, the extension 38 may have a U-shape configuration that is shaped to extend above the aperture 36 and over a portion of the substrate 12, then return to the connection surface 26 of the substrate 12 adjacent the coupling point 40. An end 42 of the extension 38 may be soldered or otherwise electrically coupled to the coupling point 40 in a suitable manner that allows each coupling projection 34 to be electrically connected to the corresponding coupling point 40.

The coupling points 40 may be mounted to or embedded within the connection surface 26 of the substrate 12 and electrically coupled to the substrate 12. In these embodiments, the coupling points 40 may be positioned behind and/or adjacent the apertures 36. In other embodiments, the coupling points 40 may be mounted to or embedded within the component surface 24, while the conductive pads 30 may be mounted to or embedded within the connection surface 26, or vice versa. One of ordinary skill in the relevant art will understand that the coupling points 40 may be positioned in any suitable location on the substrate 12 that allows the second interface connection terminal set 16 to electrically couple to the substrate 12.

In some embodiments, when the connector 10 is inserted within the corresponding connector (not shown), the corresponding connector presses against the coupling projections 34, in turn applying a compressive force to the springs 32. When the springs 32 are compressed by the corresponding connector, the spring-loaded design of each spring 32 then applies a force to create a firm electrical coupling between the corresponding connector and each coupling projection 34 when the connector 10 is inserted within the corresponding connector.

The housing 20 may be coupled to the substrate 12 proximate the end 28. The shell may be formed of composite materials, plastic materials, or other suitable materials. The housing 20 may comprise a front wall 44 and side walls 46 that are joined to form a U-shaped frame that substantially surrounds at least a portion of a front surface 48 and side surfaces 50 of the end 28. In some embodiments, the side walls 46 may have substantially the same height as or may have a greater height than the side surfaces 50, and the front wall 44 may have substantially the same height as or may have a greater height than the front surface 48. In the embodiments shown in FIGS. 3-4 and 9-10, upper edges 52 of the front wall 44 and the side walls 46 are substantially aligned with the connection surface 26. In these embodiments, lower edges 54 of the front wall 44 and the side walls 46 extend below the front surface 48 and the side surfaces 50.

As illustrated in FIGS. 1-4 and 9-10, a rear wall 56 may be coupled to a portion of the upper edges 52 of the side walls 46. The rear wall 56 may be configured to extend across the connection surface 26 behind and/or adjacent the apertures 36. An upper platform 58 may be coupled to a portion of a front surface 59 of the rear wall 56, wherein the upper platform 58 extends over the end 28 of the substrate 12, but is spaced apart from the end 28 by the height of the rear wall 56.

In some embodiments, as illustrated in FIGS. 1, 3-4, 7, and 9-10, the third interface connection terminal set 18 may be positioned proximate an interior surface 60 of the upper platform 58 and configured to be inserted within a corresponding connector using the third interface connection standard. In some embodiments, such as the embodiment illustrated in FIGS. 1, 3-4, 7, and 9-10, the third interface connection terminal set 18 may comprise a plurality of contacts 62. In certain embodiments, such as where the third interface connection standard is an eSATA I, eSATA II, eSATA III, or any other standard that is forward or backwards compatible with any of the foregoing eSATA standards, the contacts 62 may be mounted to or embedded within the interior surface 60 of the upper platform 58 and configured to electrically couple to the two differential pairs of wires, plus an additional three ground wires, of the corresponding eSATA connector when the connector 10 is inserted within the corresponding eSATA connector. In the embodiments shown in FIGS. 1, 3, and 7, the third interface connection terminal set 18 comprises seven contacts 62. However, one of ordinary skill in the relevant art will understand that any suitable number and configuration of contacts 62 may be used in conjunction with the third interface connection standard or other suitable connection standards.

Figure 3:
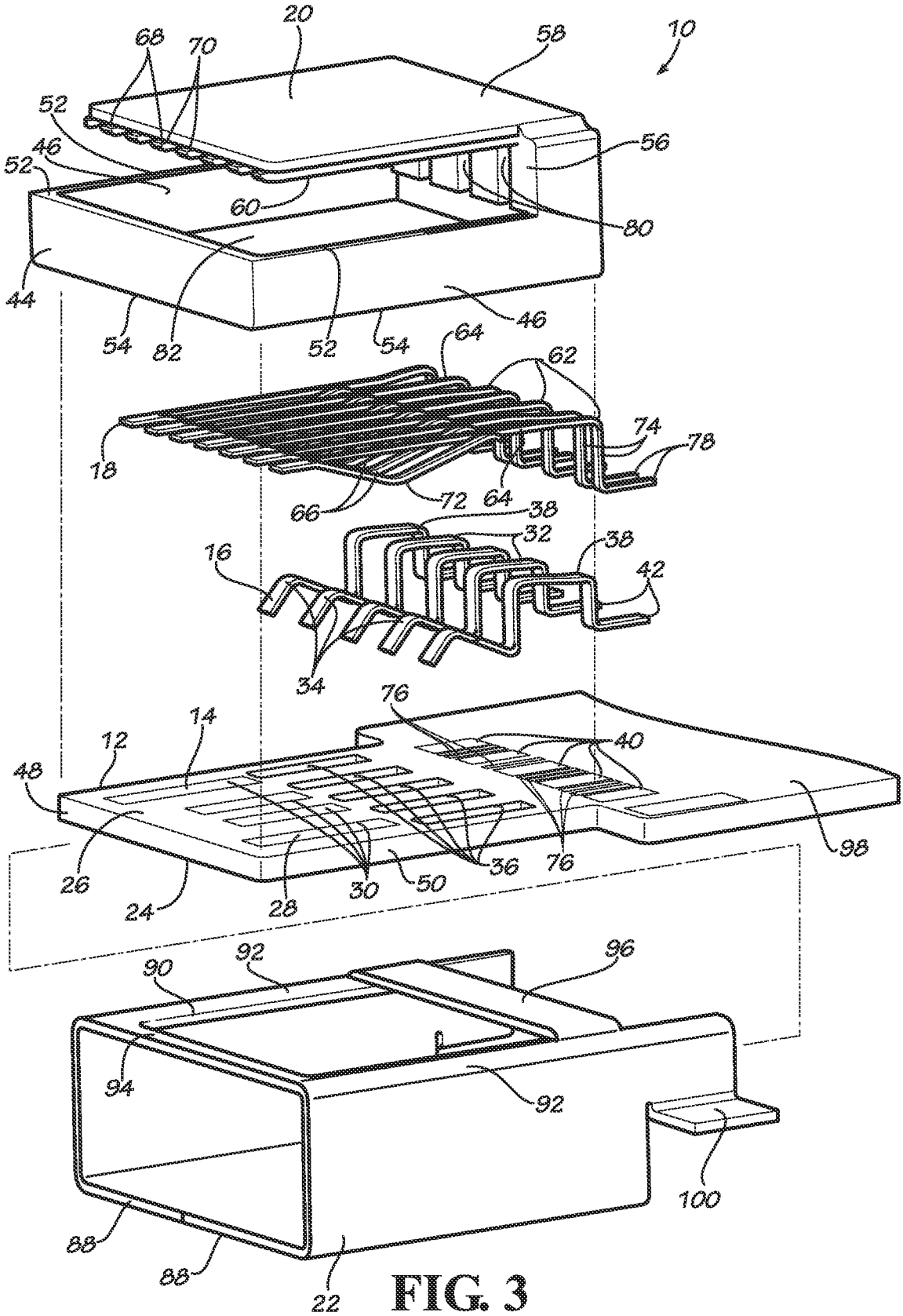
FIG. 3 is an exploded front perspective view of the connector of FIG. 1.
Figure 4:
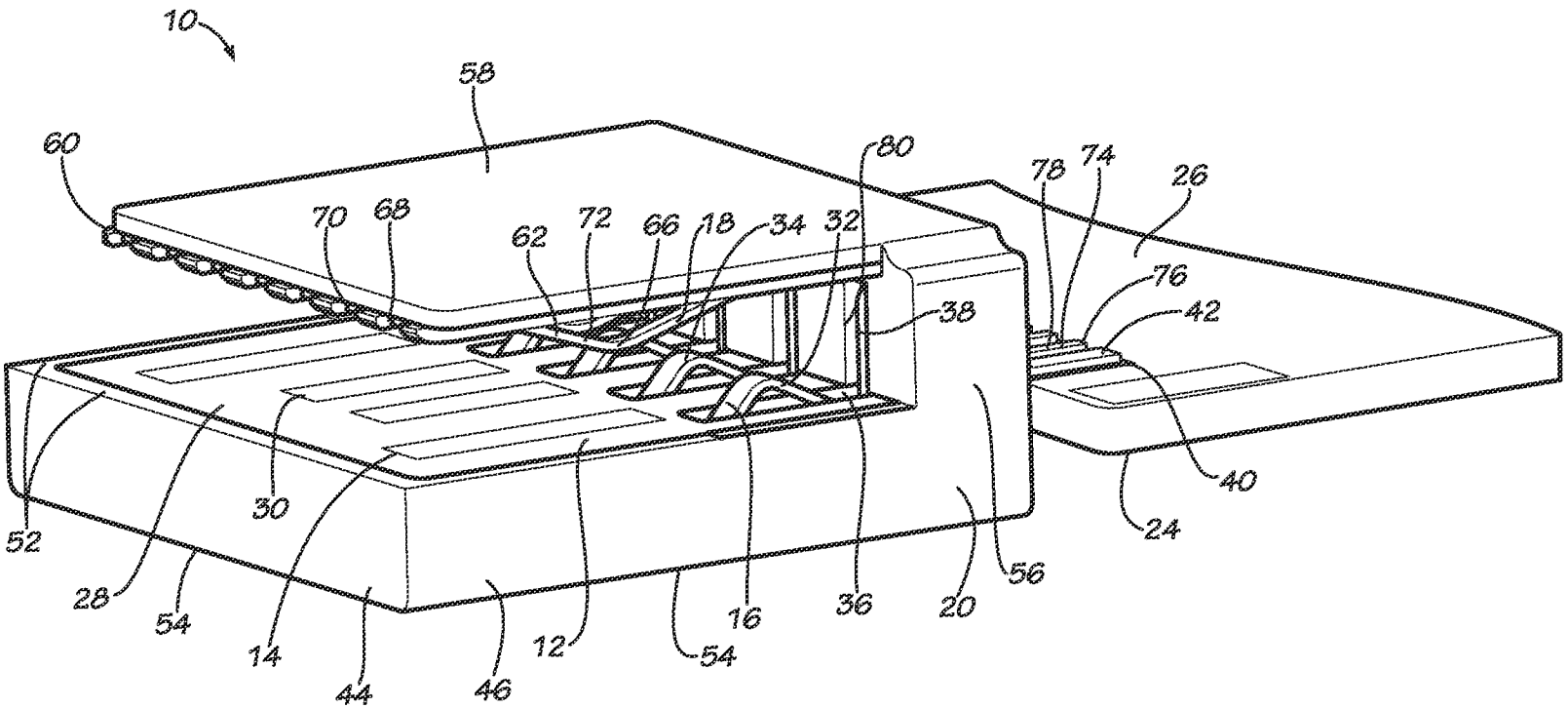
FIG. 4 is a front perspective view of the connector of FIG. 1 with the shell removed.
Figure 5:
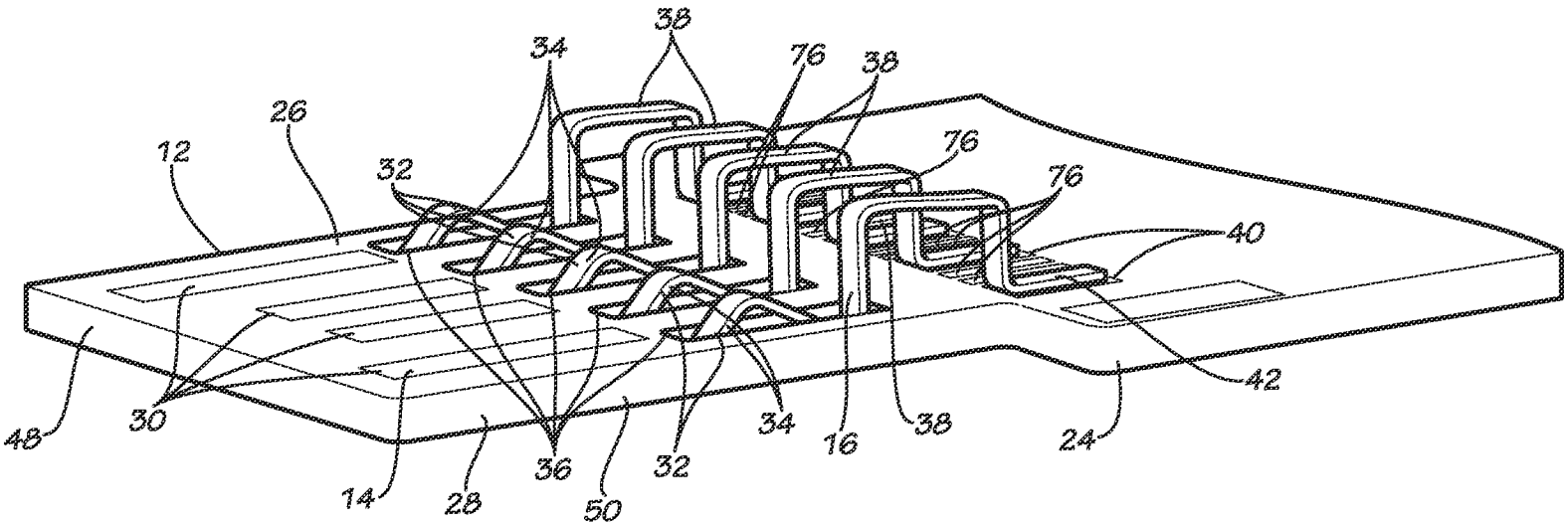
FIG. 5 is a front perspective view of the connector of FIG. 1 with the shell, housing, and third interface connectors removed.
Figure 6:
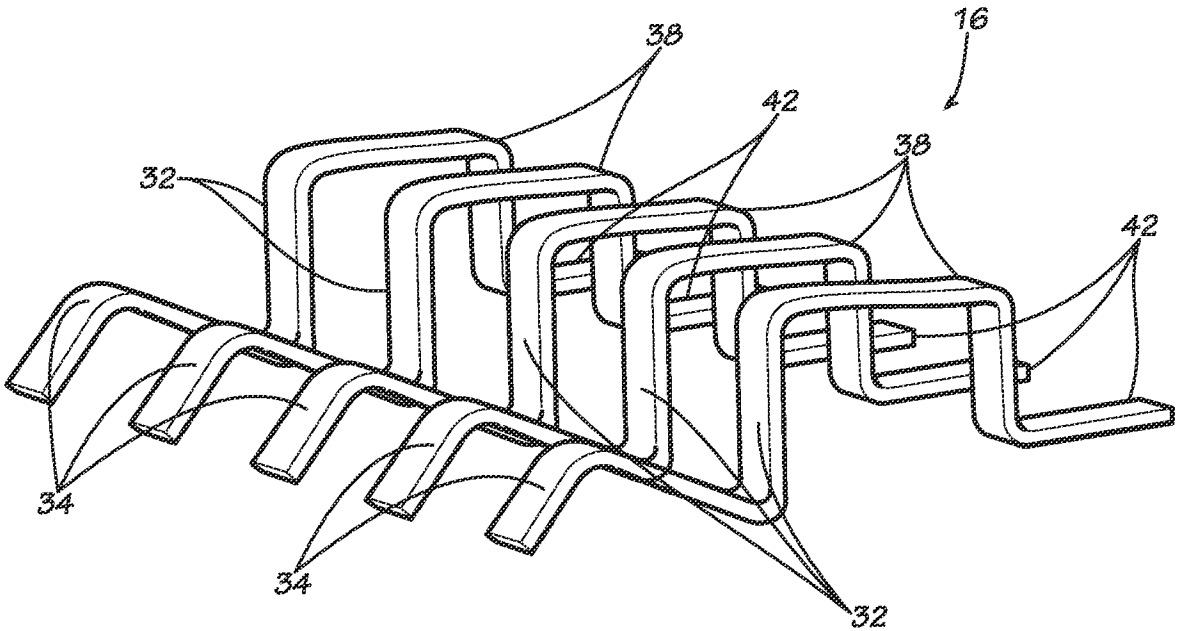
FIG. 6 is a front perspective view of a second interface connection terminal set of the connector of FIG. 1.
Figure 7:
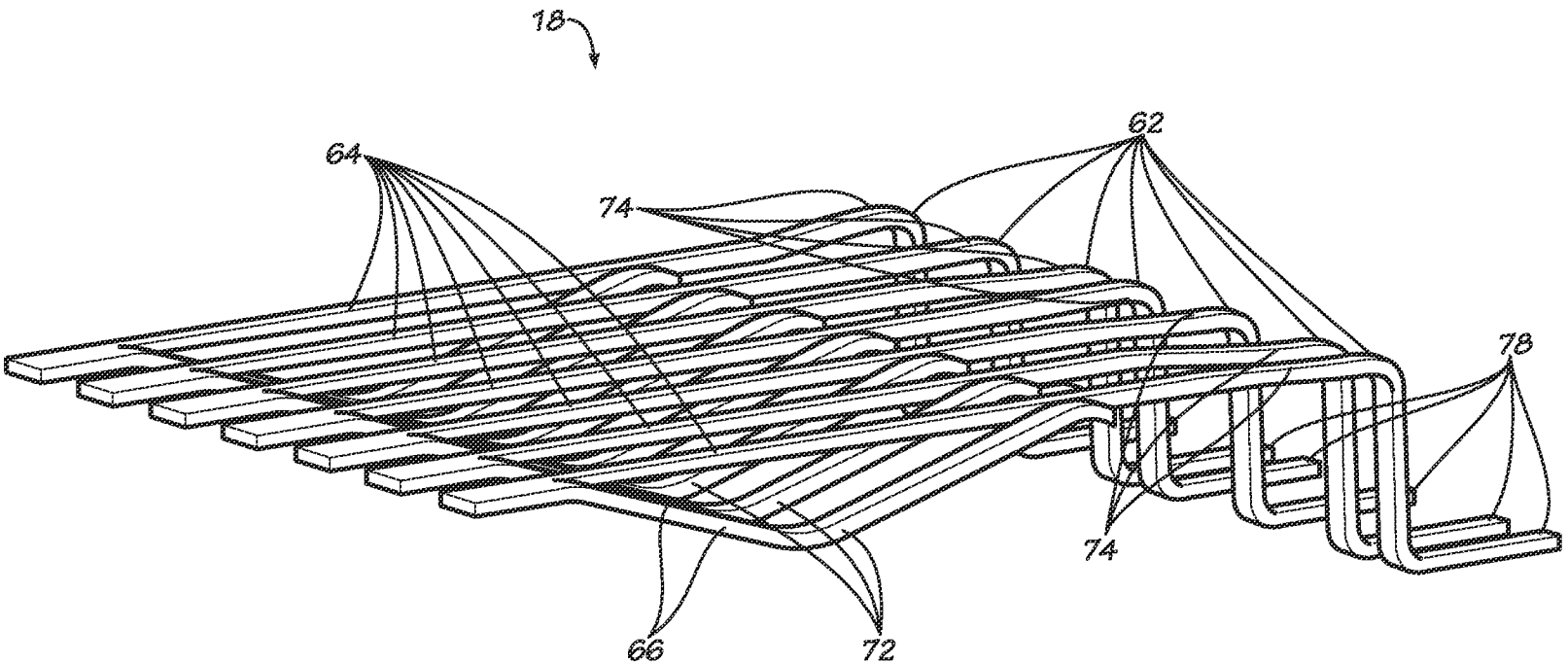
FIG. 7 is a front perspective view of a third interface connection terminal set of the connector of FIG. 1.

Each contact 62 may include a main body 64 and a spring 66, as best illustrated in FIGS. 3 and 7. Each spring 32 may be formed of a resilient material that, when bent or compressed, exerts a force to return to its original shape. One of ordinary skill in the relevant art will understand that the springs 32 may be made of any suitable material and have any suitable design that allows the third interface connection terminal set 18 to electrically couple to the corresponding connector when the connector 10 is inserted within the corresponding connector. In some embodiments, as shown in FIGS. 1 and 4, the main body 64 of each contact 62 may be positioned within a corresponding channel 68 located on the interior surface 60 of the upper platform 58, so that the interior surface 60 includes a plurality of channels 68. The main body 64 may be coupled to the spring 66 adjacent a front edge 70 of the channel 68. In some embodiments, the channel 68 is shaped so that the spring 66 may be positioned alongside the main body 64 within the channel 68.

Each spring 66 may also include a coupling projection 72, as best illustrated in FIGS. 1, 4, and 9-10. In some embodiments, the coupling projection 72 may be integrally formed with the spring 66. In other embodiments, the coupling projection 72 may be soldered or otherwise electrically coupled to the spring 66 in a suitable manner that allows the coupling projection 72 to be electrically coupled to the substrate 12. The coupling projection 72 may have any suitable shape that provides sufficient contact with the corresponding connector when the connector 10 is inserted within the corresponding connector. Examples of suitable shapes include but are not limited to a triangular, L-shape, U-shape, T-shape, solid projection having a circular or rectilinear cross-sectional shape, or other suitable shapes.

The channels 68 may be shaped so that the coupling projection 72 of each spring 66 extends through the channel 68 and is positioned below the interior surface 60, while the remainder of the spring 66 is positioned within the channel 68, when each spring 66 is in an uncompressed position.

Figure 2:
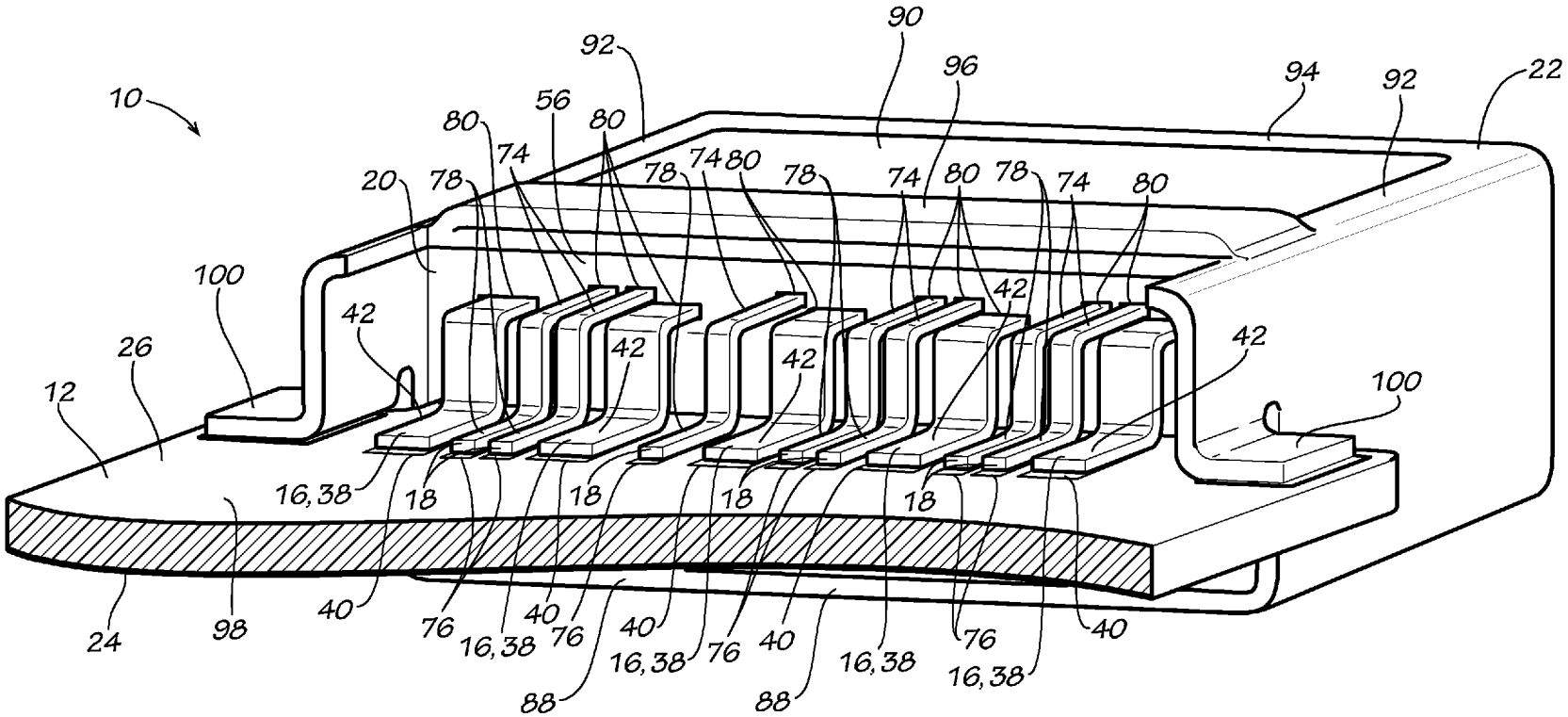
FIG. 2 is a rear perspective view of the connector of FIG. 1.

Each main body 64 may include an extension 74 that mounts to and electrically couples the spring 66 to the substrate 12 via a coupling point 76 located on the connection surface 26. The substrate 12 may include a separate coupling point 76 for each spring 66, as best shown in FIG. 2. In some embodiments, as shown in FIGS. 3 and 7, the extension 74 may have an L-shape configuration that is shaped to extend down from the upper platform 58 and over a portion of connection surface 26 of the substrate 12 adjacent the coupling point 76. An end 78 of the extension 74 may be soldered or otherwise electrically coupled to the coupling point 76 in a suitable manner that allows each coupling projection 72 to be electrically connected to the corresponding coupling point 76.

The coupling points 76 may be mounted to or embedded within the connection surface 26 of the substrate 12 and electrically coupled to the substrate 12. In these embodiments, the coupling points 76 may be positioned behind and/or adjacent the apertures 36, as well as adjacent the coupling points 40. In other embodiments, the coupling points 76 may be mounted to or embedded within the component surface 24, while the conductive pads 30 and/or the coupling points 40 may be mounted to or embedded within the connection surface 26, or vice versa. One of ordinary skill in the relevant art will understand that the coupling points 76 may be positioned in any suitable location on the substrate 12 that allows the third interface connection terminal set 18 to electrically couple to the substrate 12.

When the connector 10 is inserted within the corresponding connector (not shown), the corresponding connector presses against the coupling projections 72, in turn applying a compressive force to the springs 66. When the springs 66 are compressed by the corresponding connector, the spring-loaded design of each spring 66 then applies a force to create a firm electrical coupling between the corresponding connector and each coupling projection 72 when the connector 10 is inserted within the corresponding connector.

While in some embodiments, the first, second, and third interface connection standards may be a USB 2.0 standard, a USB 3.0 standard, and/or an eSATA I, eSATA II, eSATA III (or any other standard that is forward or backwards compatible with any of the foregoing standards), one of ordinary skill in the relevant art will understand that the three interface connection standards may be any suitable combination of interface connection standards that achieve the desired performance of the connector 10.

The rear wall 56 may include apertures 80 shaped to allow the extensions 38, 74 to pass through the rear wall 56, which may otherwise form a barrier between the springs 32, 66 and the coupling points 40, 76.

A lower surface 82 may be coupled to the lower edges 54 of the front wall 44 and the side walls 46 of the housing 20, forming a partially enclosed recess 84 between the component surface 24 of the substrate 12 and the lower surface 82. The recess 84 may provide a space for at least one controller 86 to be mounted to or embedded within the component surface 24 of the substrate 12 and electrically coupled to the substrate 12. Specifically, in some embodiments, the controller 86 may be designed as a surface mount device ("SMD") part, which makes it possible to mount the connector easily and does not require the presence of holes in the substrate 12. By locating the controller 86 within the connector 10, the connector 10 design conserves space and allows for the use of very short signal lines between the first interface connection terminal set 14, the second interface connection terminal set 16, and/or the third interface connection terminal set 18, resulting in better signals and higher transmission speed.

Figure 8:
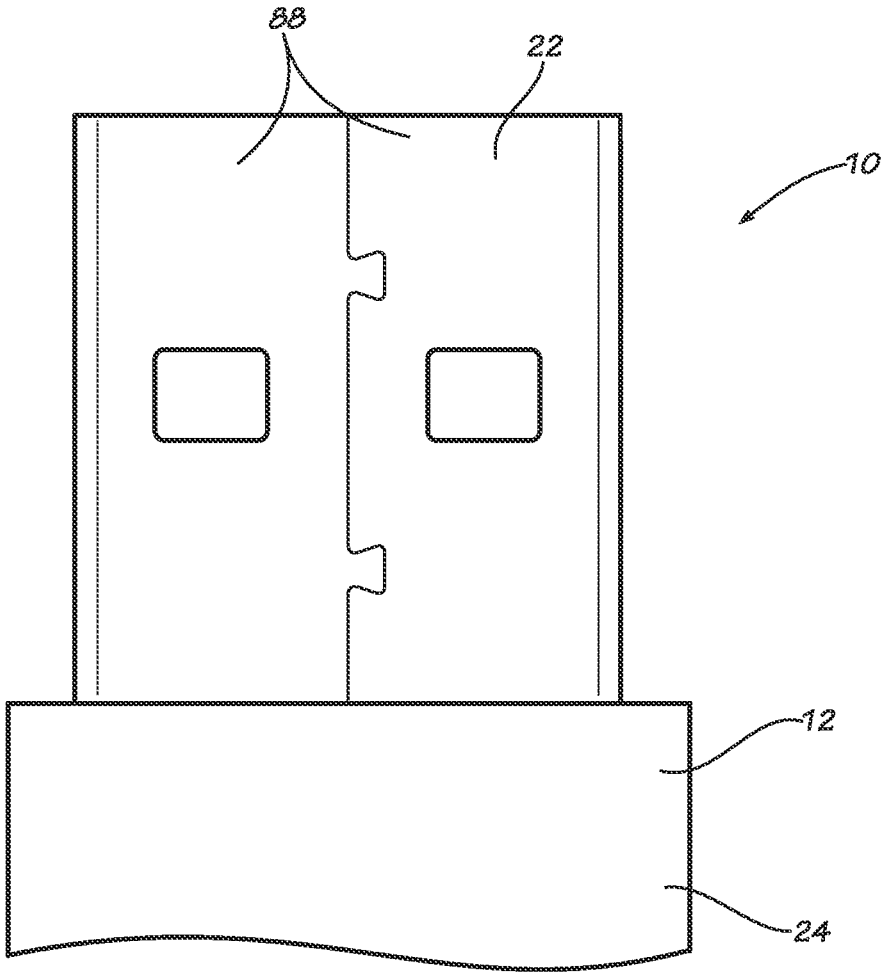
FIG. 8 is a bottom plan view of the connector of FIG. 1.
Figure 9:
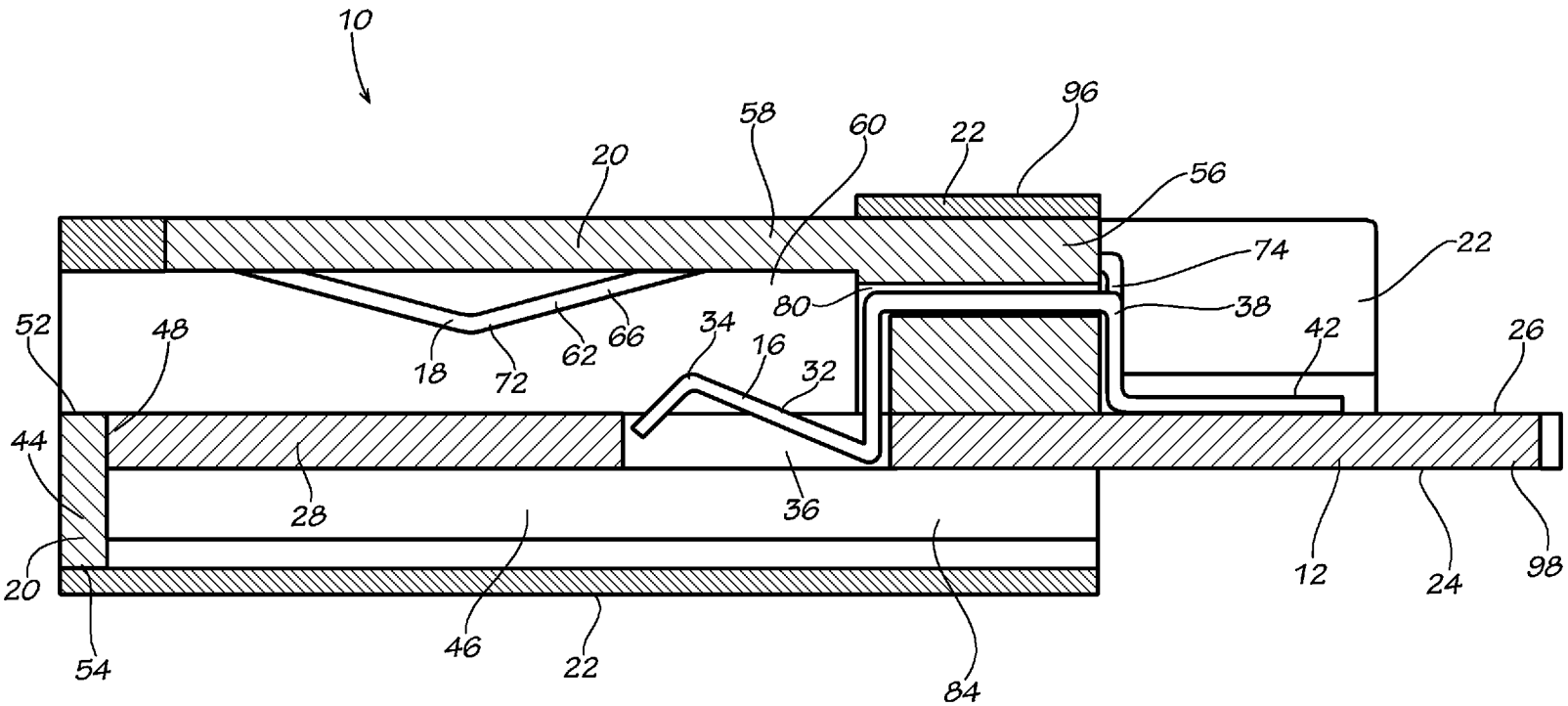
FIG. 9 is a cross-sectional view of the connector of FIG. 1 taken along line 9-9.
Figure 10:
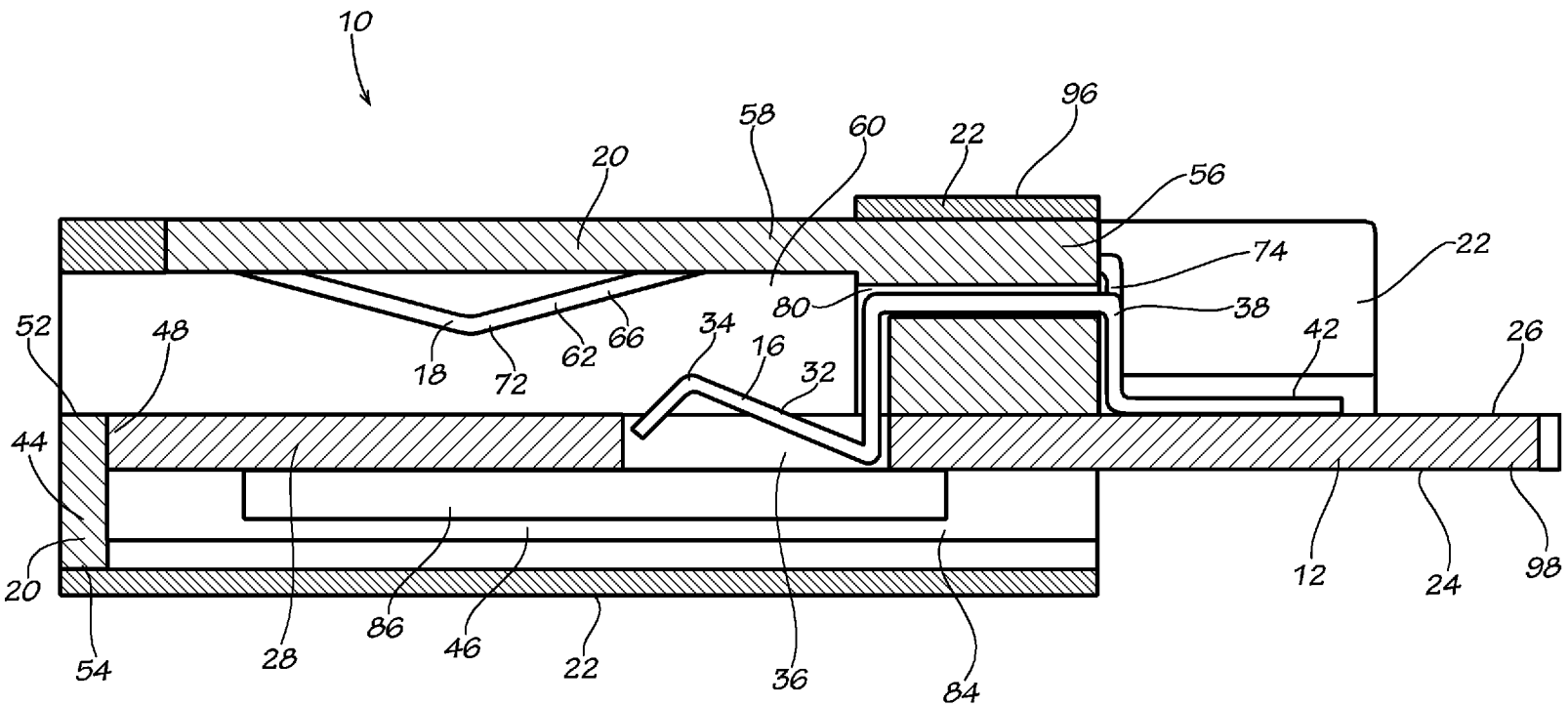
FIG. 10 is a cross-section view of the connector of FIG. 9 with a controller added.
Figure 12:
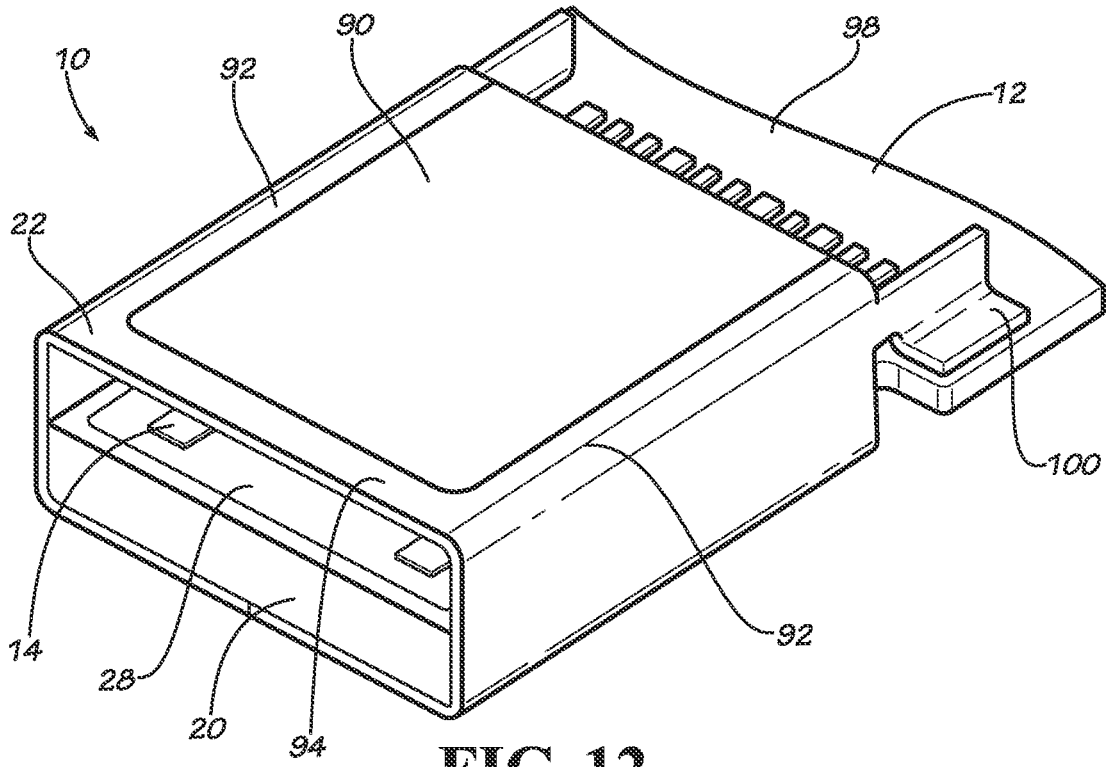
FIG. 12 is a front perspective view of a connector according to alternative embodiments of the present invention.

The shell 22 may then be coupled to the housing 20 and the substrate 12. The shell may be formed of metallic materials, composite materials, plastic materials, or other suitable materials. The shell 22 is shaped to wrap around at least a portion of the outer shape of the housing 20. Edges 88 of the shell 22 may be joined below the lower surface 82 of the housing 20, as shown in FIG. 8. In certain embodiments, the shell 22 comprises an opening 90 that is positioned adjacent the upper platform 58. The opening 90 is surrounded by sides 92, a front edge 94, and a rear bridge 96. In other embodiments, as shown in FIG. 12, the rear bridge 96 may be eliminated to reduce weight and costs.

In some embodiments, as shown in FIGS. 1-5, 8, and 12, the substrate 12 may be shaped so that the end 28 has a narrower width than a remaining portion 98 of the substrate 12. Thus, the remaining portion 98 extends outwardly past the side walls 46 of the housing 20. In these embodiments, the shell 22 may include tabs 100 that are shaped to couple to the remaining portion 98 adjacent and outside the side walls 46 of the housing 20.

Figure 11:
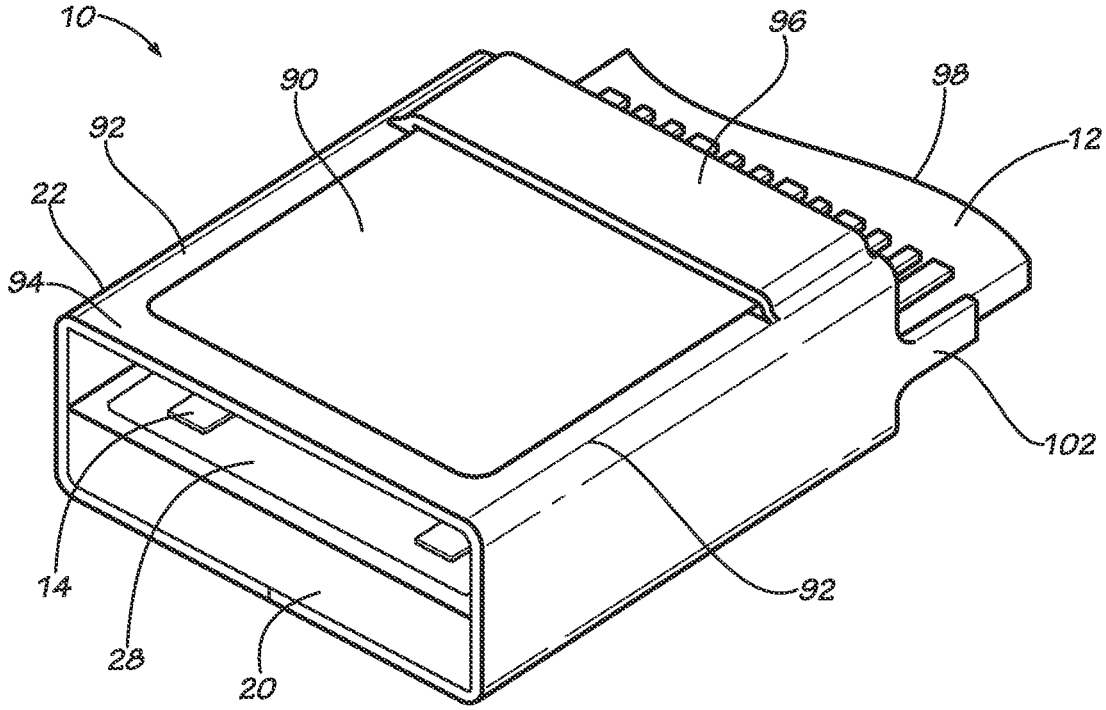
FIG. 11 is a front perspective view of a connector according to alternative embodiments of the present invention.

In other embodiments, as shown in FIG. 11, the substrate 12 has the same width in the remaining portion 98 and the end 28. In these embodiments, the shell 22 may include tabs 102 that are shaped to couple to the side surfaces 50 adjacent the side walls 46 of the housing 20.

The foregoing is provided for purposes of illustrating, explaining, and describing embodiments of the present invention. Further modifications and adaptations to these embodiments will be apparent to those skilled in the art and may be made without departing from the scope or spirit of the invention.

That which is claimed is:

1. A connector comprising:

(a) a printed circuit board comprising a plurality of apertures configured to receive at least a portion of a second interface connection terminal set;

(b) a first interface connection terminal set comprising a plurality of conductive pads embedded to be exposed upon the printed circuit board;

(c) a second interface connection terminal set comprising a plurality of springs electrically coupled to the printed circuit board;

(d) a third interface connection terminal set comprising a plurality of conductive contacts electrically coupled to the printed circuit board;

(e) a housing coupled to the printed circuit board and surrounding at least a portion of the first interface connection terminal set, the second interface connection terminal set, and the third interface connection terminal set;

(f) a shell coupled to the housing and the printed circuit board; and (g) at least one controller electrically coupled to the printed circuit board and configured to operate the first, second, and third interface connection terminal sets;

wherein the first interface connection terminal set and the second interface connection terminal set are configured to support at least two interface connection standards with interfaces that are mechanically different.

2. The connector of claim 1, wherein the shell is metal.

3. The connector of claim 1, wherein the housing comprises a plurality of channels, wherein each of the plurality of conductive contacts of the third interface connection terminal set are partially enclosed within each of the plurality of channels.

4. The connector of claim 1, wherein the at least one controller is at least partially surrounded by the housing.

5. A connector comprising:

(a) a printed circuit board comprising a component surface and a connection surface having a plurality of apertures configured to receive at least a portion of a second interface connection terminal set;

(b) a first interface connection terminal set comprising a plurality of conductive pads embedded to be exposed upon the connection surface of the printed circuit board;

(c) a second interface connection terminal set comprising a plurality springs electrically coupled to the connection surface of the printed circuit board;

(d) a third interface connection terminal set comprising a plurality of conductive contacts electrically coupled to the connection surface of the printed circuit board;

(e) a housing coupled to the printed circuit board, wherein a recess is positioned between a lower surface of the housing and the component surface of the printed circuit board;

(f) at least one controller positioned within the recess and electrically coupled to the component surface of the printed circuit board and configured to operate the first, second, and third interface connection terminal sets; and (g) a shell coupled to the housing and the printed circuit board;

wherein the first interface connection terminal set and the second interface connection terminal set are configured to support at least two interface connection standards with interfaces that are mechanically different.

6. The connector of claim 5, wherein the shell is metal.

7. The connector of claim 5, wherein the housing comprises a plurality of channels, wherein each of the plurality of conductive contacts of the third interface connection terminal set are partially enclosed within each of the plurality of channels.

8. A connector comprising:

(a) a printed circuit board comprising a plurality of apertures, wherein each of a plurality of springs of a second interface connection terminal set are partially enclosed within each of the plurality of apertures;

(b) a first interface connection terminal set comprising a plurality of conductive pads embedded to be exposed upon the printed circuit board;

(c) a second interface connection terminal set comprising a plurality of springs electrically coupled to the printed circuit board;

(d) a third interface connection terminal set comprising a plurality of conductive contacts electrically coupled to the printed circuit board;

(e) a housing coupled to the printed circuit board and surrounding at least a portion of the first interface connection terminal set, the second interface connection terminal set, and the third interface connection terminal set;

(f) a shell coupled to the housing and the printed circuit board; and (g) at least one controller electrically coupled to the printed circuit board and configured to operate the first, second, and third interface connection terminal sets;

wherein the first interface connection terminal set and the second interface connection terminal set are configured to support at least two interface connection standards with interfaces that are mechanically different.

9. The connector of claim 8, wherein the shell is metal.

10. The connector of claim 8, wherein the housing comprises a plurality of channels, wherein each of the plurality of conductive contacts of the third interface connection terminal set are partially enclosed within each of the plurality of channels.

11. The connector of claim 8, wherein the at least one controller is at least partially surrounded by the housing.

* * * * *

UNITED STATES PATENT AND TRADEMARK OFFICE

CERTIFICATE OF CORRECTION

PATENT NO. : 8,523,610 B2
APPLICATION NO. : 13/362343
DATED : September 3, 2013
INVENTOR(S) : Martin Kuster It is certified that error appears in the above-identified patent and that said Letters Patent is hereby corrected as shown below:

In the Specification

In Column 5, Line 63:
Delete "66, as best illustrated in FIGS. 3 and 7. Each spring 32 may be" and insert
-- 66, as best illustrated in FIGS. 3 and 7. Each spring 66 may be --

In Column 5, Line 66:
Delete "skill in the relevant art Will understand that the springs 32 may" and insert
-- skill in the relevant art will understand that the springs 66 may --

In the Claims

In Claim 1, Column 8, Line 7:
Delete "(c) a second interface connection terminal set comprising a" and insert
-- (c) the second interface connection terminal set comprising a --

In Claim 5, Column 8, Line 45:
Delete "(c) a second interface connection terminal set comprising a" and insert
-- (c) the second interface connection terminal set comprising a --

In Claim 8, Column 9, Line 12:
Delete "(c) a second interface connection terminal set comprising a" and insert
-- (c) the second interface connection terminal set comprising a --

Signed and Sealed this
Nineteenth Day of September, 2017

Joseph Matal

Joseph Matal
*Performing the Functions and Duties of the*
*Under Secretary of Commerce for Intellectual Property and*
*Director of the United States Patent and Trademark Office*